US006315191B1

(12) United States Patent
Willis

(10) Patent No.: US 6,315,191 B1
(45) Date of Patent: Nov. 13, 2001

(54) BOX HANDLES

(76) Inventor: Jimmy Keith Willis, 387 Hwy. 167, Daleville, AL (US) 36322

( * ) Notice: Subject to any disclaimer, the term of this patent is extended or adjusted under 35 U.S.C. 154(b) by 0 days.

(21) Appl. No.: 09/663,682

(22) Filed: Sep. 18, 2000

(51) Int. Cl.[7] ..... B65D 5/46
(52) U.S. Cl. ..... 229/117.23; 220/772
(58) Field of Search ..... 229/117.23, 117.26, 229/117.24, 117.25; 220/766, 772; 294/27.1

(56) References Cited

U.S. PATENT DOCUMENTS

| | | | | |
|---|---|---|---|---|
| 462,541 | * | 11/1891 | Evans et al. | 229/117.23 |
| 1,524,399 | * | 1/1925 | Krueger | 229/117.23 |
| 2,021,788 | * | 11/1935 | Janowitz | 229/117.26 |
| 2,158,697 | * | 5/1939 | Harrison | 229/117.23 |
| 2,194,232 | * | 3/1940 | Peters | 229/117.26 |
| 2,775,382 | * | 12/1956 | Kayat | 229/117.23 |
| 3,017,068 | * | 1/1962 | Jaeger et al. | 229/117.24 |
| 3,153,507 | * | 10/1964 | House | 229/117.23 |
| 3,836,051 | * | 9/1974 | Schmechel | 229/117.09 |
| 4,850,502 | * | 7/1989 | Davis | 220/772 |
| 5,358,175 | * | 10/1994 | Cai | 229/117.26 |
| 5,647,624 | * | 7/1997 | Beshara, Jr. | 294/27.1 |
| 5,868,310 | * | 2/1999 | Leszczynski | 229/405 |

FOREIGN PATENT DOCUMENTS

| | | | | |
|---|---|---|---|---|
| 522279 | * | 3/1956 | (CA) | 229/117.23 |
| 3209220 | * | 9/1983 | (DE) | 229/117.23 |

* cited by examiner

*Primary Examiner*—Gary E. Elkins

(57) ABSTRACT

"BOX HANDLES" are handles that are applied to an ordinary shipping box in order to make the box easier to lift and carry. The handles are made of two parts, one being the handle, the other being the handle re-inforcement piece. The two parts are attached to each other with adhesive to form one finished handle. Two of these finished handles are then attached to a box. One to each side panel. When the box is filled, closed and ready for shipping, the handles make the box easier to lift and carry.

5 Claims, 4 Drawing Sheets

BOX HANDLES

BACKGROUND OF THE INVENTION

This invention relates to handles on boxes. Boxes made from materials such as corrugated paper, pasteboard, cardboard, etc., used by companies to ship their products. These boxes are filled with the product and closed, usually by taping or strapping. The boxes are then often difficult to lift and carry because of their weight and awkwardness. I feel that my invention would solve this problem.

BRIEF SUMMARY OF THE INVENTION

This invention pertains specifically to handles that are attached to each side of a shipping box. The boxes could be of different sizes and materials (corrugated paper, pasteboard, cardboard, etc.). The handles would solve the problem of lifting and carrying the boxes.

DETAILED DESCRIPTION OF THE INVENTION

Figure 1:
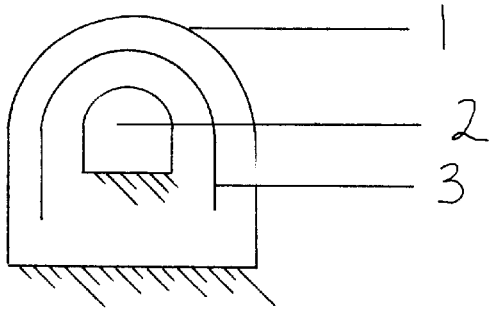
FIG. 1 shows the handle re-inforcement piece.

The handle re-inforcement piece (1) shown in FIG. 1 would be made of the same material that the box is made of. It would consist of a hand hold (2) and one additional cut (3).

Figure 2:
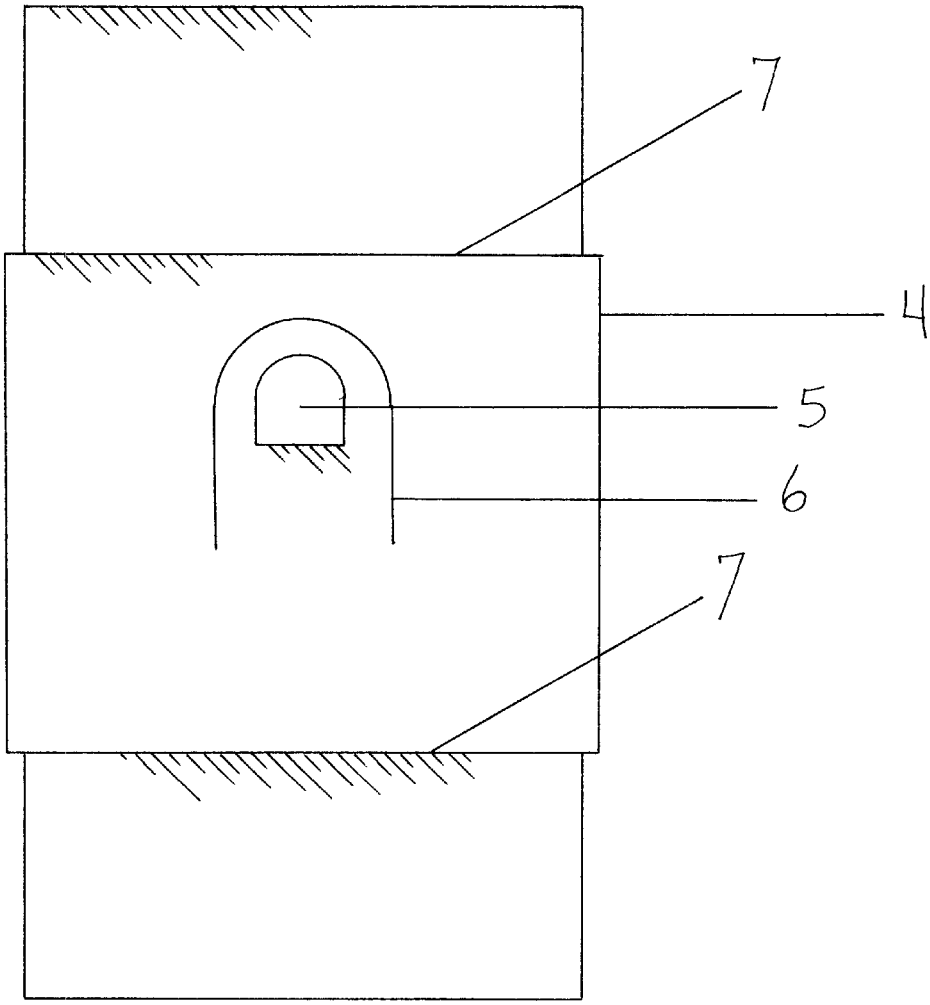
FIG. 2 shows the handle.

The handle (4) is shown in FIG. 2, and would also be made of the same material that the box is made of. The handle will also consist of a hand hold (5) and one additional cut (6) which will match up precisely with the hand hold (2) and the one additional cut (3) in the handle reinforcement piece shown in FIG. 1. The handle will have two folds (7) which will match up precisely with the folds on the box to make the top and bottom side flaps.

Figure 3:
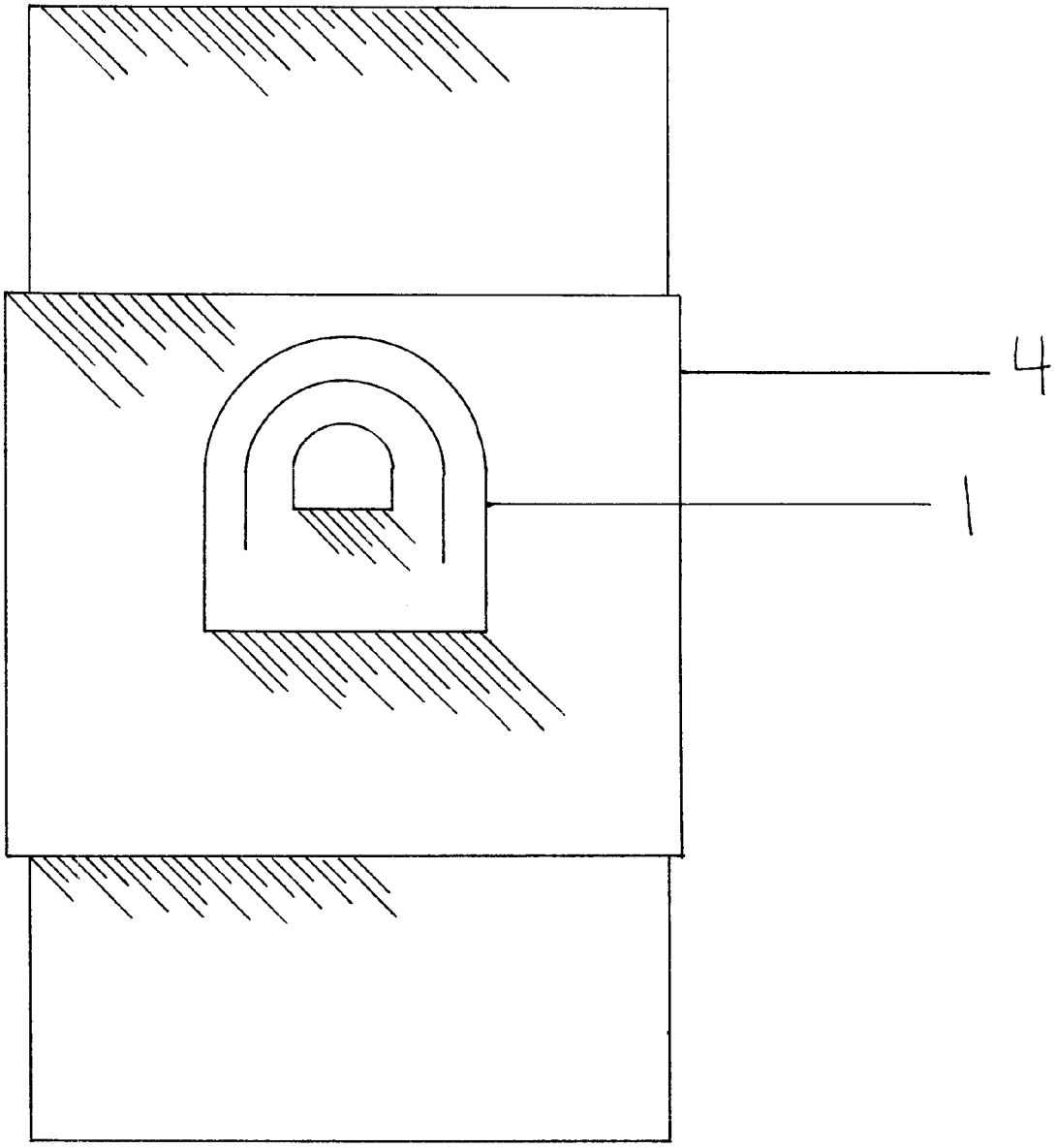
FIG. 3 shows the handle re-inforcement piece attached to the handle.

The finished handle as shown in FIG. 3, is made by adhering the handle re-inforcement piece (1) directly on top of the handle (4), so that the hand hold (2) and the additional cut (3) match up precisely with the hand hold (5) and the additional cut (6).

Figure 4:
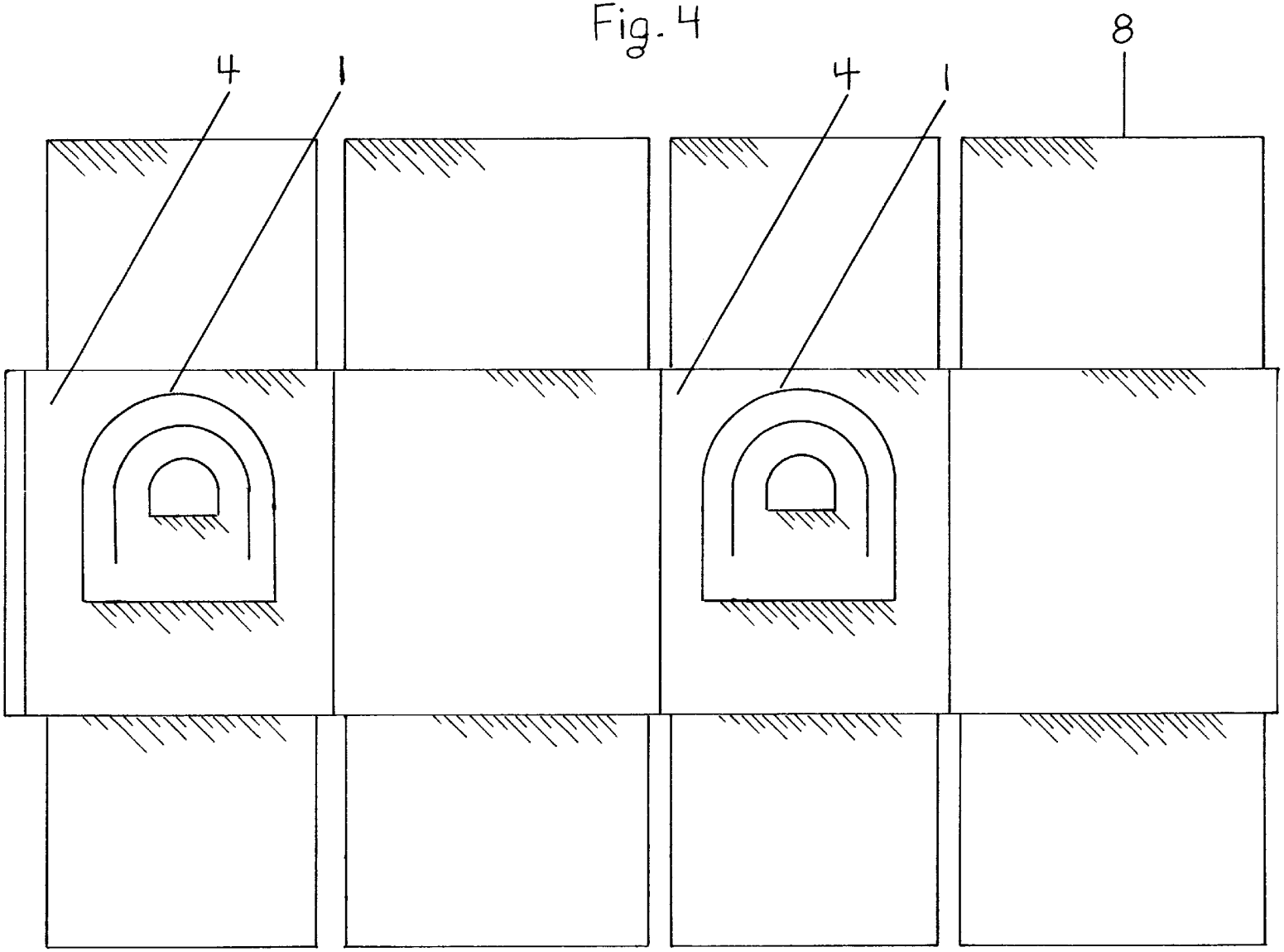
FIG. 4 shows a shipping box after it has been cut into the proper shape, opened and laying flat, and the finished handles have been attached.

FIG. 4 shows the shipping box (8), cut into the proper shape, opened and laying flat, with the finished handles, consisting of the handle re-inforcement piece (1) and the handle (4), adhered to the box in their proper place. All parts are put together using adhesive.

Figure 5:
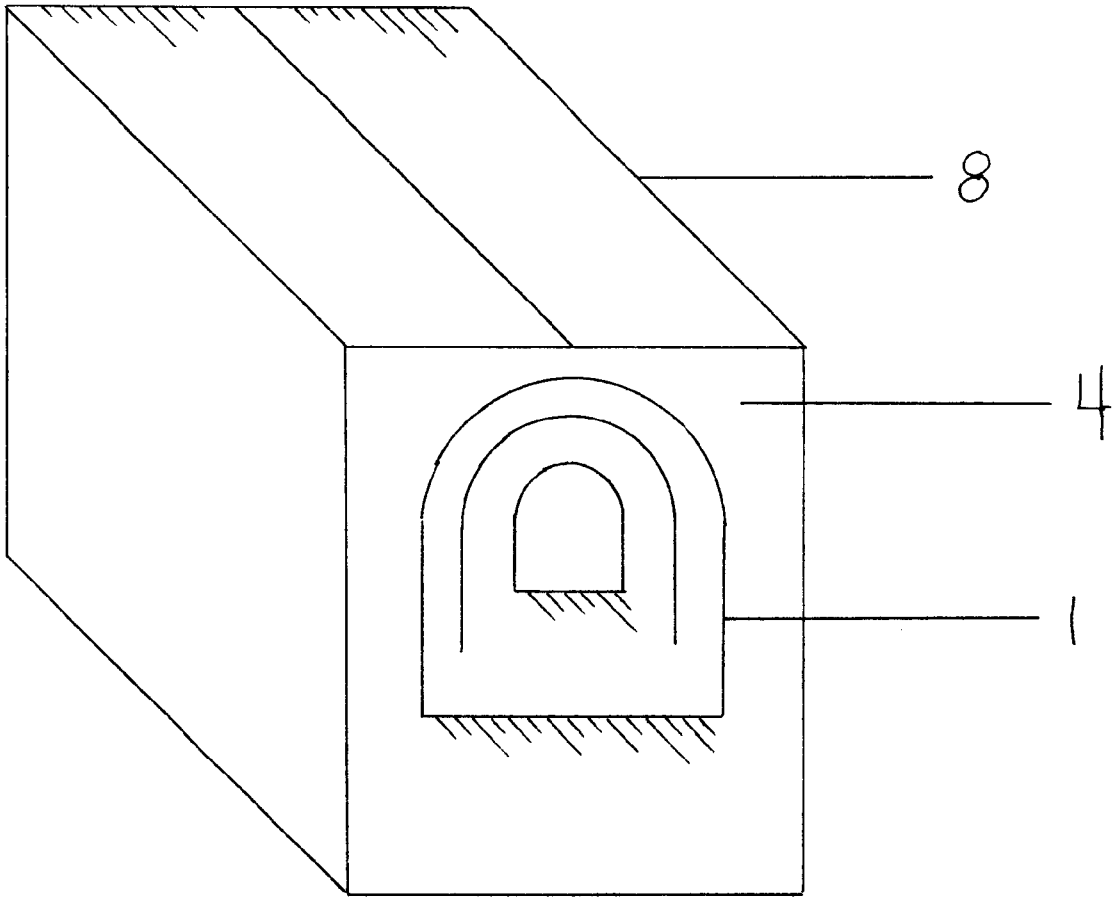
FIG. 5 shows a shipping box, folded into it's normal box shape, with the finished handles attached.

The shipping box (8) is shown in FIG. 5 folded into it's normal box shape with the finished handles attached.

I claim:

1. A finished handle comprising, a handle and a reinforcing piece of different dimensions and adhesively secured together, each of said handle and said reinforcing piece comprising a hand hold and a slit formed partially around the respective hand hold, said hand holds and slits overlying and being aligned with one another respectively to form said finished handle.

2. A box and a finished handle, said fished handle as set forth in claim 1, wherein said finished handle is secured to a side wall of said box.

3. A box and a pair of finished handles, each said handle as set forth in claim 1, wherein each of said finished handles is secured to a respective sidewall of said box.

4. A box and a finished handle as set forth in claim 2 wherein said reinforcing piece comprises a piece of material of substantially the same size as the sidewall of the box.

5. A box and a finished handle as set forth in claim 2 wherein the box includes at least one closure flap foldably secured to the sidewall, the reinforcing piece including a folded segment secured to the closure flap.

* * * * *